United States Patent [19]

Jones

[11] 4,387,771

[45] Jun. 14, 1983

[54] WELLHEAD SYSTEM FOR EXPLORATORY WELLS

[76] Inventor: Darrell L. Jones, 1991 Foster Ave., Ventura, Calif. 93001

[21] Appl. No.: 261,091

[22] PCT Filed: Oct. 14, 1980

[86] PCT No.: PCT/US80/01359

§ 371 Date: Feb. 17, 1981

§ 102(e) Date: Feb. 17, 1981

[51] Int. Cl.[3] ..... E21B 33/035; E21B 33/038; E21B 43/01; E21B 43/013

[52] U.S. Cl. ..... 166/341; 166/347; 166/349; 166/368

[58] Field of Search ..... 166/341, 347, 349, 351, 166/360, 365, 366, 368, 367

[56] References Cited

U.S. PATENT DOCUMENTS

| | | | |
|---|---|---|---|
| 3,143,171 | 4/1964 | Otteman et al. | 166/343 |
| 3,242,991 | 3/1966 | Johnson et al. | 166/367 |
| 3,347,567 | 10/1967 | Watkins | 166/341 |
| 3,618,661 | 11/1971 | Peterman | 166/343 |
| 3,716,100 | 2/1973 | Nelson | 166/343 |
| 3,834,460 | 9/1974 | Brun et al. | 166/344 |
| 4,192,383 | 3/1980 | Kirkland | 166/341 |

OTHER PUBLICATIONS

Synder, Robert E., *New Concept Unveiled for Subsea Completion, Production", World Oil,* Sep. 1976, pp. 41–45.

*Primary Examiner*—Stephen J. Novosad

[57] ABSTRACT

A wellhead (16) for an exploratory well carries a latch profile ring (24) at a location just above the wellhead housing (14). Accessory modules (38) latch onto this profile (36) while leaving the conventional upper latch profile (28) free for conventional production equipment. The accessory module may carry flowline alignment apparatus (40) to use the exploratory well as a satellite well. It may carry cantilever well modules (70) to permit the drilling of adjacent wells or a retrievable guide pile module (43) to provide placement of a guide pile required for proper placing of a jacket for an offshore platform.

10 Claims, 5 Drawing Figures

WELLHEAD SYSTEM FOR EXPLORATORY WELLS

BACKGROUND OF THE INVENTION

The invention relates to subsea wells and in particular to a wellhead system whereby for a slight initial expense, accessory modules may be used to turn an exploratory well into a production well.

When it is known in subsea drilling that a well will successfully and economically produce oil, substantial investment is made in the guide base used during the drilling. This investment is directed to strengthening the guide base and locating various components so that the well may be produced by remotely attached equipment.

The large majority of subsea wells, however, are exploratory either as a wildcat or for the purpose of defining the area of an oil field. These exploratory wells use a standard permanent guide base with no provisions for attachments. Should one wish to produce oil from the conventional exploratory well, there are several alternatives at specific geographical locations. A spool piece may be attached to the wellhead and the conductor run up to the surface where a fixed platform carries a surface tree, with production being similar to a land based well. In other locations it is possible to send divers to the seabed so that the various alignment structures may be clamped to the guide base and erected at that location. The use of the spool piece is not acceptable at all locations, and the use of divers is not only very expensive and dangerous but impractical at substantial depth.

SUMMARY OF THE INVENTION

It is an object of the invention to utilize exploratory subsea wells for later production of oil when desired. It is a further object to provide this capability with only a small initial investment which must be made when drilling the exploratory well. Significant investment in the additional apparatus required for production is deferred until a decision is made to produce the particular exploratory well.

It is a further object to provide flexibility in the apparatus which may be added to the exploratory well so that different uses of the well in production may be selected as desired in the particular circumstance.

A wellhead housing (often termed a 30 inch housing) is conventionally secured to the seabed along with a permanent guide structure. A wellhead (sometimes termed a wellhead housing) supported by the housing and cemented in place contains not only the conventional latching profile near its upper end but a second latching profile located just above the top of the wellhead housing. This second profile is located on a separate profile ring which is supported from the housing and which in turn supports the wellhead.

The permanent guide base attached to the housing also carries a plurality of alignment posts which permits alignment of later installed equipment to an approximate location. Precise location and appropriate support are supplied by the arrangement which latches to the second latching profile.

An accessory module has a frame which includes locking dogs attached to the frame and arranged to annularly surround the wellhead. An engaging ring permits locking the dogs to the second latch profile so that the frame is rigidly supported from the wellhead. This module is arranged so that when locked into position it leaves the first latch profile free for attachment of a production tree or a production riser if required.

Production apparatus carried on the frame is selected depending on the particular need at the time that the decision is made to utilize the exploratory well as a production well. If the well is to be a satellite well producing to another location, a production tree is secured to the conventional latching profile. The module carries an alignment structure which permits pulling in a flowline and holding it in place at a precise location for stroking of the production tree flange.

When it is desired to drill additional wells, a cantilever well module is carried which permits the drilling of an adjacent well from a floating platform while the jacket and fixed platform to be installed are being fabricated. Where a jacket is to be installed over the well or complex of wells, a retrievable guide pile module permits precise alignment of a guide pile. The module is then removed and the guide pile used for alignment of a leg of the platform jacket.

DESCRIPTION OF THE PREFERRED EMBODIMENT

Figure 1:
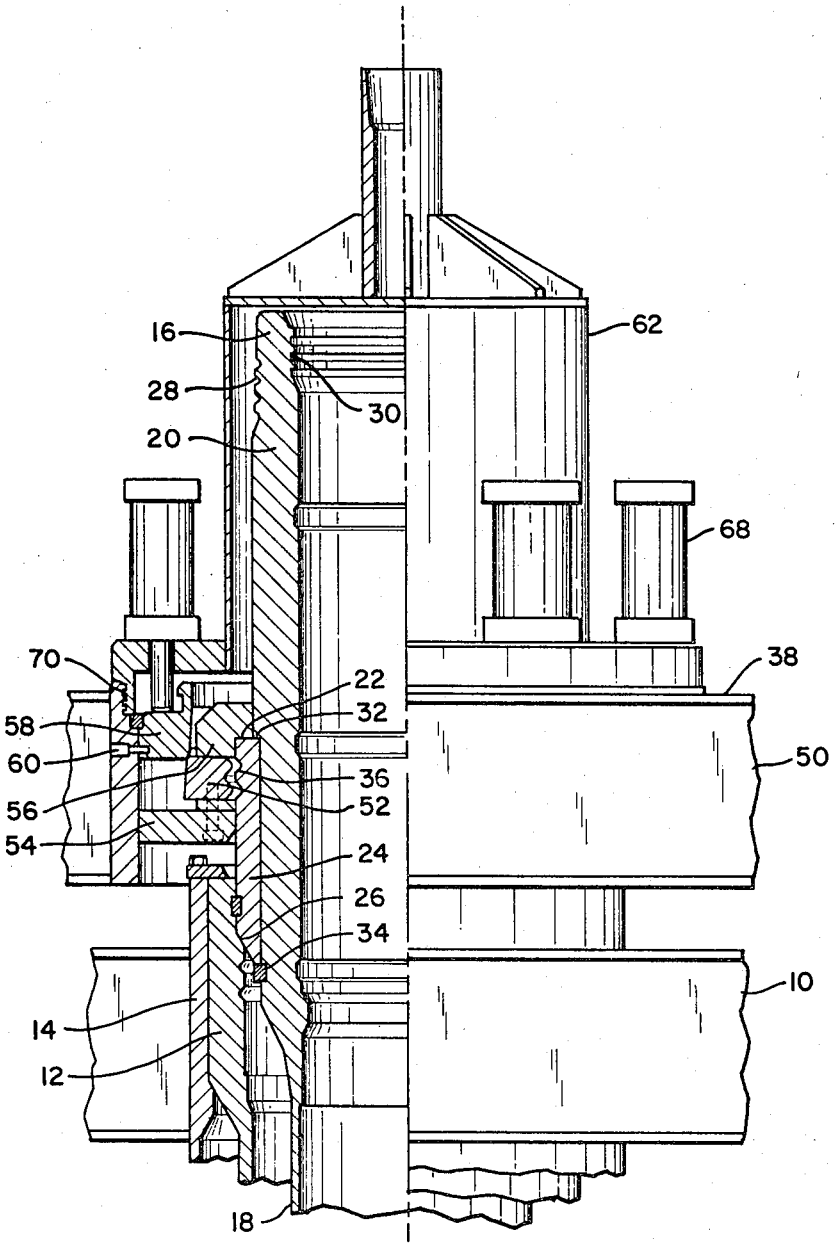
FIG. 1 shows the wellhead accessory connector with a running tool.

In accordance with the conventional method of drilling a subsea well, a temporary guide base (not shown) is lowered to the seabed, and a 36 inch hole may be drilled for a 30 inch casing. Once this hole is drilled to the desired depth, a permanent guide base 10 which has been fastened to the 30 inch wellhead housing 12 through clamp 14 is lowered through the temporary guide base. This structure carries the desired length of 30 inch casing (not shown), and the permanent guide base is placed in a horizontal position on the temporary guide base. The 30 inch housing is then cemented in place.

After additional drilling, the wellhead 16 carrying 20 inch casing 18 is lowered and supported from the wellhead housing 12. The wellhead body 20 is supported on an upwardly facing shoulder 22 of a profile ring 24. This ring is in turn supported on an upwardly facing shoulder 26 of the wellhead housing 12. The wellhead housing 12 is frequently called a 30 inch housing, and the wellhead 16 a wellhead housing in the art. The above-described terminology will, however, be used in this description.

The wellhead 16 is then cemented into place with additional casing strings later placed therein and cemented as drilling progresses.

The wellhead includes the conventional first latch profile 28 at the upper end for the connection of the BOP stack during drilling. This profile may be used for the later connection of a production tree or for the connection of a conductor riser in the event that internal threads 30 are damaged.

The profile ring 24 is connected to the wellhead body 20 by engagement between shoulder 32 and split ring 34. This profile ring preferably has a close fit with the wellhead body since high loads are carried through the profile ring into the wellhead. The only investment required for the contingency that one might wish to produce an exploratory well is the addition of the profile ring 24 with a second latching profile 36.

Figure 2:
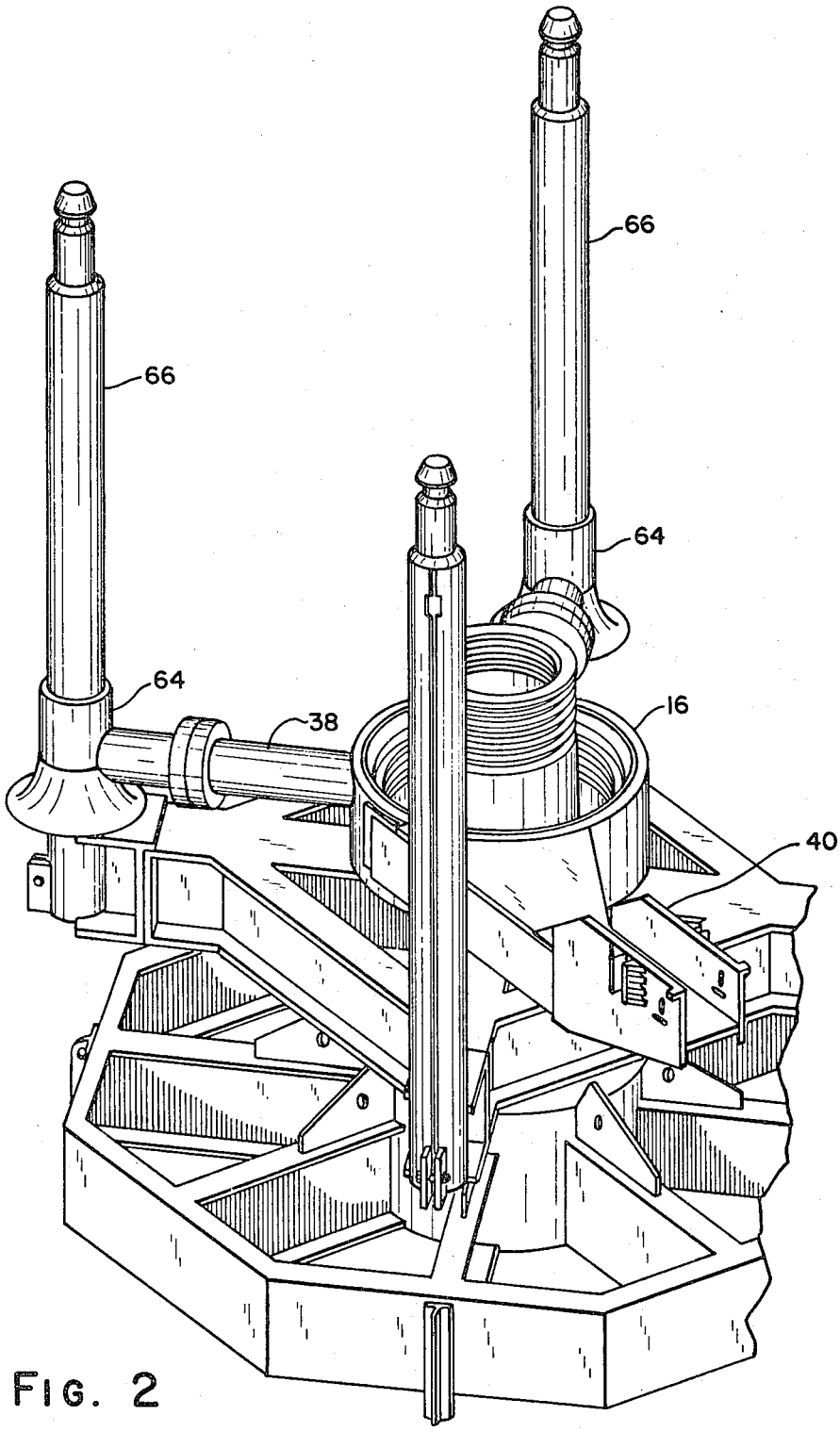
FIG. 2 is a view with a flowline alignment module.
Figure 3:
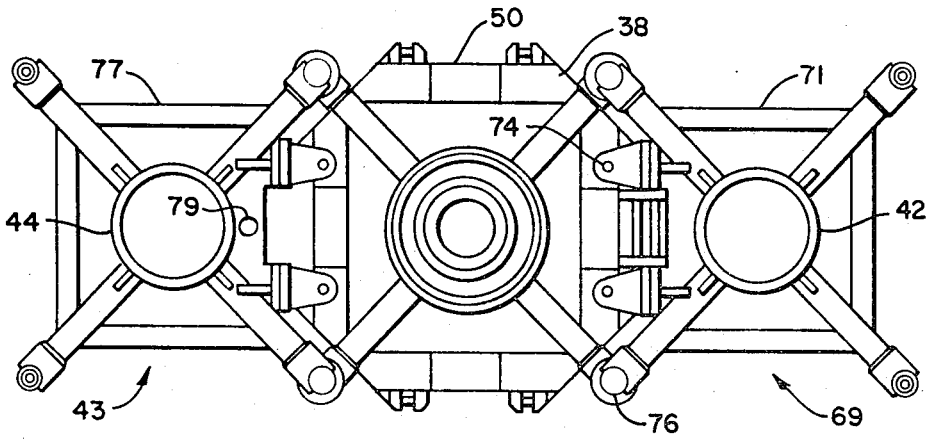
FIG. 3 is a plan view of a retrievable guide pile module and a cantilever well module.
Figure 4:
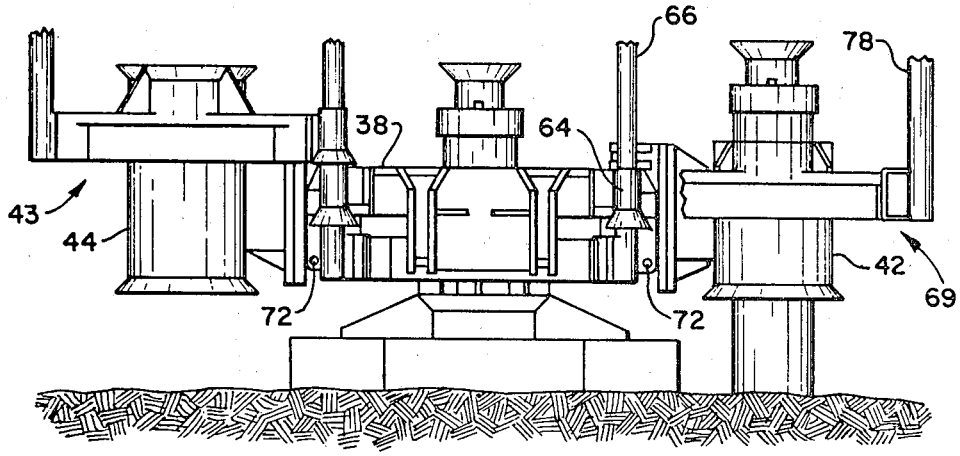
FIG. 4 is a side elevation of FIG. 3.

The vast majority of exploratory wells will be closed off and abandoned either because of a dry hole or because of insufficient petroleum to justify production from the well. Should, however, it be desired to produce from one of these exploratory wells, an accessory module 38 is used. If it is desired to produce the well as a satellite well, the accessory module 38 carries an alignment flange 40 shown in FIG. 2. If additional wells are to be produced, the accessory module 38 carries a cantilever well module 69 with a guide structure 42 as illustrated in FIGS. 3 and 4. If a jacket and platform are to be installed over the wells, the accessory module 38 carries a retrievable guide pile module 43 carrying a cylindrical guide 44.

Figure 5:
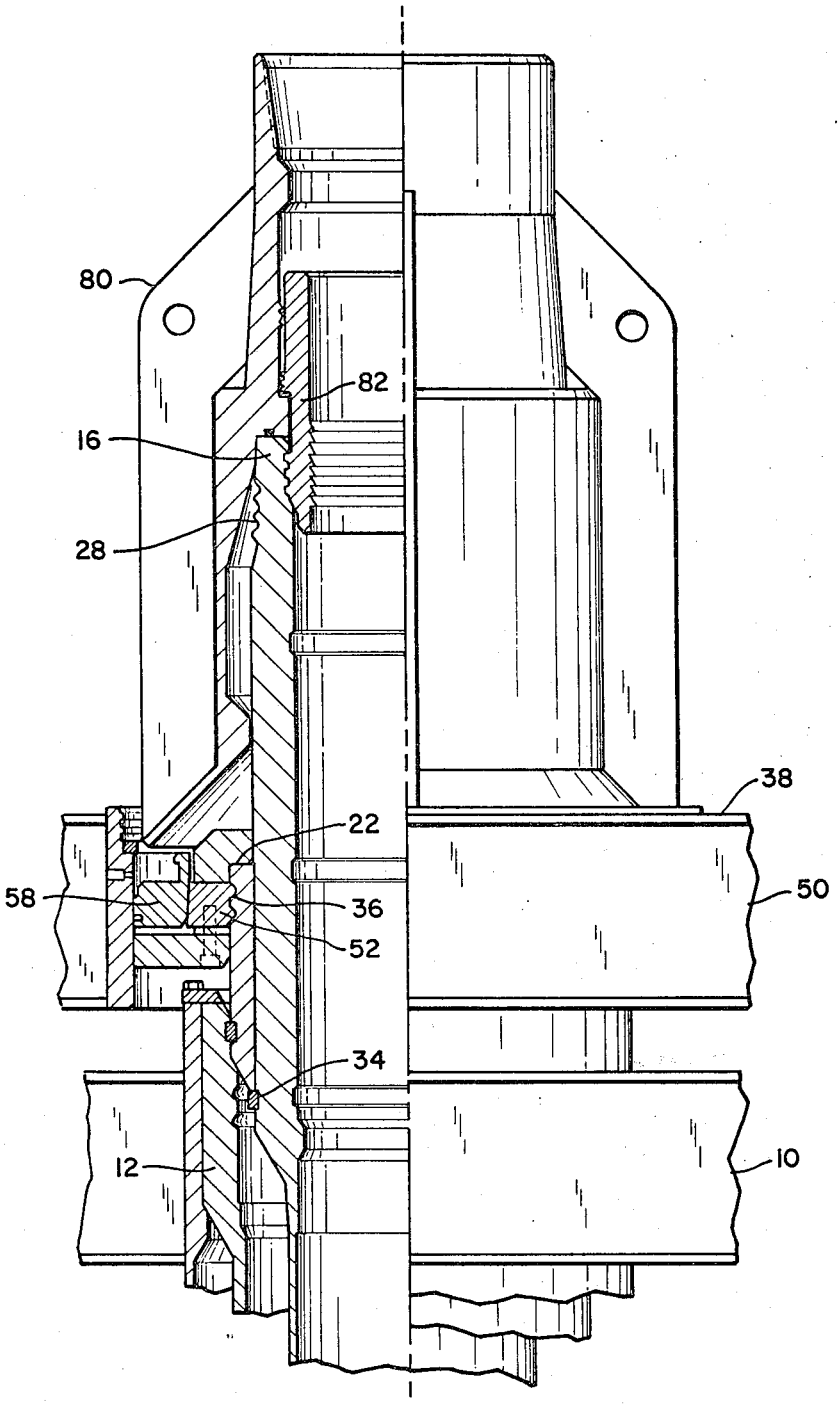
FIG. 5 illustrates the wellhead accessory connector with a tieback assembly in place.

The accessory module is illustrated in FIG. 1 in its landed but unlocked position and in FIG. 5 in its locked position. The accessory module includes a frame 50 with locking dogs 52 attached thereto. These dogs are arranged to annularly surround the wellhead 16 and are held in the frame 50 between support ring 54 and landing ring 56. The landing ring 56 may be formed of segments which pass between adjacent dogs 52 for attachment to support ring 54. A locking cam 58 is held in the retracted position before installation of the module by shear pin 60.

The accessory module is lowered on the running tool 62 with guide funnels 64 engaging guide posts 66 of the permanent guide base. This provides general alignment of the module so that the landing ring 56 clears the upper end of the wellhead. When the landing ring 56 engages shoulder 22, landing is detected by relaxation of the load. At this time locking cylinders 68 are energized driving the locking cam downwardly and forcing locking dogs 52 into engagement with the second profile 36. The camming action operates through a 4 degree angle so that the cam will remain in place once it is driven down. If desired, an additional locking mechanism may be added to provide increased assurance of the lock.

Thereafter the locking cylinders are released, and the locking tool is rotated and disengaged from the frame 50 by threads 70. The accessory module is now held in a precise alignment with respect to the wellhead housing 12. Accordingly, accessory apparatus located on this accessory module is in itself in precise relationship with the wellhead housing; and accordingly, remote operating equipment can be successfully designed to make connections to production trees and for other required operations.

Loading from the accessory module frame is direct into the wellhead 16 without passing through the permanent guide base, which normally would not be sufficiently strong to carry these loads. Furthermore, the particular design of the permanent guide structure and tolerances held on that structure have no effect on the location of the accessory apparatus.

The use of the profile ring 24, instead of machining the latch profile in the wellhead itself, has several advantages. A landing shoulder is readily provided. It is less expensive to fabricate since it can readily be supplied as a separate forging without making the wellhead forging oversized with the required machining away of material. In the rare case where a high stress concentration in the profile connection combines with an undetected material defect, cracking of the landing ring would not result in failure, but the system would continue to operate.

Should it be desired to develop the exploratory well into a satellite producing well, the accessory module 38 is formed as a flowline alignment module by including alignment flange 40 on the frame. The approximate location of the accessory module and the angular orientation is maintained by the interaction between guide funnels 64 and posts 66. Precise spatial relationship between the wellhead 16 and the alignment flange 40 is held by the locking dog arrangement. This provides a strong structure which passes loads directly into the wellhead 16 and therethrough into the multiple casing strings which are cemented into the seabed. The precise alignment permits remote operation of a flowline pull-in tool and remote stroking and connection of the production tree sales line. It also holds the flowline in place once it is pulled into position.

If it is found desirable to produce oil from a cluster of wells adjacent the exploratory well, drilling may continue from a floating platform while the fixed platform jacket is being fabricated. This is accomplished by the use of the cantilever well module 69 which will provide the spacing and guidance for additional wells. The cantilever module has a structure 71 which is attached to the base module 38 by pins 74 fitting into openings in the base module. Hooks located on the cantilever module also engage rod 72, to preclude the module swinging outwardly. The cantilever well module 69 also carries engaging rings 76 which engage the guide posts 66 of the permanent guide base, and carries on its own structure 71 additional guide posts 78 from which additional cantilever well modules may be later hung.

After the well module 69 is in place and the initial hole is drilled, another wellhead housing with the initial string of casing is supported from the module and thereafter cemented in place. At this time the module is capable of carrying its own load, and additional modules may be run down to provide means for drilling additional wells.

When it is desired to place a production platform over producing subsea wellheads, it is desirable to locate the platform accurately with respect to the wells. This can be accomplished by driving a pile a preselected distance from the wellhead and floating a jacket into place and lowering it over the pile. A retrievable guide pile module 43 is used for this purpose. It has a structure 77 supported from the base module 38 in much the same manner as the cantilever well module. After installing the guide pile through cylindrical guide 44, the module is retrieved by engaging a J groove in opening 79 with a running tool. The module may then be retrieved to the surface. The guide pile is left spaced away from the wellhead and is ready at this time to accept the platform jacket.

FIG. 5 illustrates the dogs 52 in their locked position engaging the second profile 36 for holding the base module 38 in place. Also in place in this illustration is the tieback assembly 80 which is engaged and locked to the upper end of the wellhead 16 with lockdown nut 82. This is simply one illustration of utilization of the upper end of the wellhead housing with the base module in place. Alternatively, a production tree could be in place engaging first profile 28 or in the event of damage to the internal threads of the housing, a riser tieback assembly could be latched onto the first profile. In order to provide continuing access to the upper end of the wellhead for other apparatus, the second profile 36 is located on the lower end of the wellhead only a short distance above the wellhead housing 12.

It can thus be seen that for a nominal initial investment, the profile ring 24 is extended beyond the size required for landing the wellhead 16 in the wellhead housing 12, and a second latching profile is provided on this profile ring. No additional investment is required except in those situations where some utilization of the exploratory well is desired. There is no additional investment in strengthening the permanent guide base or the wellhead housing nor is it required that precision be required in the manufacture or design to provide for later remote subsea work.

A base module is provided with means for engaging this profile so that it may be held in precise relationship with the ability to carry substantial load into the wellhead. The base module may carry the various described components so that complete flexibility as to decisions for future utilization of the exploratory well is available.

I claim:

1. A wellhead system for an exploratory subsea well adapted to accept accessory modules comprising: a wellhead housing; a generally cylindrical wellhead body supported and cemented within said housing, and extending above said housing; a first latch profile located on the outer periphery of said wellhead near the upper end for alternatively attaching a blowout preventer and production apparatus; a guide base attached to said wellhead housing; a plurality of vertical guide posts located on said guide base a preselected distance from said wellhead housing; a separate profile ring of larger diameter than said body; means for retaining said profile ring on a lower portion of said body; and a second latch profile located on said profile ring substantially below said first latch profile.

2. An apparatus as in claim 1 including means for supporting said profile ring from said housing; and means for supporting said body from said profile ring.

3. An apparatus as in claim 1 or 2 wherein said profile ring includes a substantially horizontal upwardly facing shoulder a preselected distance above said second profile, as a landing shoulder for later installed modules.

4. A wellhead accessory system for an exploratory subsea well comprising: a wellhead housing; a generally cylindrical wellhead supported and cemented within said housing, and extending above said housing; a first latch profile located on the outer periphery of said wellhead near the upper end for alternatively attaching a blowout preventer and production apparatus; a second latch profile located on the outer periphery of said wellhead above said housing, but substantially below said first latch profile; a guide base attached to said wellhead housing; a plurality of vertical guide posts located on said guide base a preselected distance from said wellhead housing; an accessory module having a frame, locking dogs attached to said frame and arranged to annularly surround said wellhead, engaging means for locking said dogs with said second latch profile and for rigidly securing said frame to said wellhead, a plurality of guide funnels spaced to engage said guide posts for providing approximate alignment of said frame with respect to said wellhead, and well accessory apparatus carried on said frame; and said accessory module arranged to leave said first latch profile free when said module is locked to said wellhead.

5. An apparatus as in claim 4 wherein said wellhead includes: a cylindrical body; a separate profile ring of larger diameter than said body; means for retaining said profile ring on a lower portion of said body; and said second latch profile located on said profile ring.

6. An apparatus as in claim 5 including means for supporting said profile ring from said housing; and means for supporting said body from said profile ring.

7. An apparatus as in claim 5 wherein said profile ring includes a substantially horizontal upwardly facing shoulder a preselected distance above said second profile; and said accessory module includes a downwardly facing landing ring located the same preselected distance above said dogs.

8. An apparatus as in any one of claims 4 through 7 wherein said accessory apparatus comprises: an alignment flange for aligning flowline connections with production tree lines, said alignment flange rigidly secured in precise spatial relationship from said dogs in their latched position, and in approximate spatial relationship from said guide funnels.

9. An apparatus as in any one of claims 4 through 7 wherein said accessory apparatus comprises: a cantilever module for adding an additional well adjacent the exploratory well including; a module structure, means located on said structure for engaging said frame and for supporting said module structure as a cantilever therefrom, and a cylindrical housing supportable on said structure for supporting large diameter casing during cementing of the casing in the well hole.

10. An apparatus as in any one of claims 4 through 7 wherein said accessory apparatus comprises: a retrievable guide pile module for spacing and guiding of guide piles for the installation of a platform jacket including; a modular structure; means located on said structure for engaging said frame and for supporting said structure as a cantilever therefrom, a hollow guide cylinder supported in spaced relationship from said means for engaging said frame for placement of a guide pile therethrough, and means for retrieving said guide pile module.

* * * * *